United States Patent [19]

Wegener et al.

[11] 4,338,212

[45] * Jul. 6, 1982

[54] MIXED NONIONIC DETERGENT COMPOSITION

[75] Inventors: Ingo Wegener, Dusseldorf; Johann Glasl, Solingen; Achim Werdehausen, Haan, all of Fed. Rep. of Germany

[73] Assignee: Henkel Kommanditgesellschaft auf Aktien (Henkel KGaA), Dusseldorf-Holthausen, Fed. Rep. of Germany

[ * ] Notice: The portion of the term of this patent subsequent to Nov. 18, 1997, has been disclaimed.

[21] Appl. No.: 205,244

[22] Filed: Nov. 10, 1980

[30] Foreign Application Priority Data

Nov. 29, 1979 [DE] Fed. Rep. of Germany ..... 2948100

[51] Int. Cl.[3] ..... C11D 1/825

[52] U.S. Cl. ..... 252/174.22; 252/174.21; 252/DIG. 1

[58] Field of Search ..... 252/174.21, 174.22, 252/DIG. 1

[56] References Cited

U.S. PATENT DOCUMENTS

| | | | |
|---|---|---|---|
| 3,406,208 | 10/1968 | Blaser et al. | 252/174.21 X |
| 3,708,364 | 1/1973 | Kalopissis et al. | 252/156 |
| 3,933,923 | 1/1976 | Osberghaus | 260/615 |
| 4,234,444 | 11/1980 | Wegener et al. | 252/174.22 |
| 4,247,424 | 1/1981 | Kuzel et al. | 252/528 |

FOREIGN PATENT DOCUMENTS

| | | |
|---|---|---|
| 2360200 | 6/1974 | Fed. Rep. of Germany . |
| 720463 | 1/1972 | South Africa . |

*Primary Examiner*—P. E. Willis, Jr.

*Attorney, Agent, or Firm*—Hammond & Littell, Weissenberger and Muserlian

[57] ABSTRACT

A mixed nonionic detergent composition having a reduced viscosity at room temperature and whose aqueous solution has a substantially reduced viscosity at room temperature consisting essentially of:

(a) from 40% to 60% by weight of at least one compound of the formula:

$$R^1-O-(CH_2CH_2O)_n-H$$

wherein $R^1$ represents the hydrocarbon moiety of a fatty alcohol having from 6 to 18 carbon atoms and n is a number from 4 to 15, and (b) from 60% to 40% by weight of at least one compound of the formula:

$$\begin{array}{ccc} & R^2-CH-CH_2 & \\ & \quad\;\; | \qquad\;\; | & \\ H-(OCH_2CH_2)_p-O & & O-(CH_2CH_2O)_q-H \end{array}$$

wherein $R^2$ represents an alkyl having from 8 to 14 carbon atoms and p and q are each a number from 0 to 15, the sum of p+q being a number from 4 to 15.

2 Claims, No Drawings

MIXED NONIONIC DETERGENT COMPOSITION

BACKGROUND OF THE INVENTION

This invention relates to a detergent composition based on mixtures of nonionic surface-active compounds or tensides having a reduced viscosity at room temperature.

Adducts of ethylene oxide and fatty alcohols possess detergent characteristics and have a wide range of application. These products are not satisfactory, however, since they are difficult to pour at temperatures in the range of from 5° to 20° C., because of their high viscosity. Attempts to reduce the viscosity of the products by dilution with water lead to undesirable gel formation in most cases.

The addition of an anionic surface-active compound to the condensation products of linear fatty alcohols with ethylene oxide in amounts of 1% to 10% by weight has been recommended in the German Published Application DE-OS No. 22 05 337, to avoid these deterimental phenomena. This step has the disadvantage that the characteristics of the nonionic tensides are changed completely by the addition of anionic tensides so that the turbidity points of the ethylene oxide adducts are shifted far into the higher temperatures or disappear completely.

OBJECTS OF THE INVENTION

An object of the present invention is to obtain a detergent composition based on condensation products of linear fatty alcohols with ethylene oxide which has a reduced viscosity at ambient temperature and whose aqueous solutions have a substantially reduced viscosity at room temperature.

Another object of the present invention is the obtaining of a mixed nonionic detergent composition having a reduced viscosity at room temperature and whose aqueous solution has a substantially reduced viscosity at room temperature consisting essentially of:

(a) from 40% to 60% by weight of at least one compound of the formula:

$$R^1—O—(CH_2CH_2O)_n—H$$

wherein $R^1$ represents the hydrocarbon moiety of a fatty alcohol having from 6 to 18 carbon atoms and n is a number from 4 to 15, and (b) from 60% to 40% by weight of at least one compound of the formula:

$$\begin{array}{l} \qquad\quad R^2—\underset{|}{CH}—\underset{|}{CH_2} \\ H—(OCH_2CH_2)_p—O \quad O—(CH_2CH_2O)_q—H \end{array}$$

wherein $R^2$ represents an alkyl having from 8 to 14 carbon atoms and p and q are each a number from 0 to 15, the sum of p+q being a number from 4 to 15.

These and other objects of the invention will become more apparent as the description thereof proceeds.

DESCRIPTION OF THE INVENTION

We have now discovered detergent compositions based on adducts of ethylene oxide and fatty alcohols that have a reduced viscosity at room temperature, like the known mixtures with anionic tensides, without possessing the disadvantages of the latter. The new compositions contain adducts of ethylene oxide and vicinal alkane-1,2-diols.

The subject of the invention thus is a detergent composition that is characterized by a content of 40% to 60% by weight of compounds of Formula I:

$$R^1—O—(CH_2CH_2O)_n—H \qquad \text{I}$$

in which $R^1$ represents a saturated or unsaturated hydrocarbon moiety of a fatty alcohol with 6 to 18 carbon atoms and n is a number from 4 to 15, and a content of 60% to 40% by weight of compounds of Formula II:

$$\begin{array}{l} \qquad\quad R^2—\underset{|}{CH}—\underset{|}{CH_2} \\ H—(OCH_2CH_2)_p—O \quad O—(CH_2CH_2O)_q—H \end{array}$$

in which $R^2$ represents an alkyl radical with 8 to 14 carbon atoms, while p and q represent numbers from 0 to 15 and the sum p+q lies in the range from 4 to 15.

More particularly, the present invention relates to a mixed nonionic detergent composition having a reduced viscosity at room temperature and whose aqueous solution has a substantially reduced viscosity at room temperature consisting essentially of:

(a) from 40% to 60% by weight of at least one compound the formula:

$$R^1—O—(CH_2CH_2O)_n—H$$

wherein $R^1$ represents the hydrocarbon moiety of a fatty alcohol having from 6 to 18 carbon atoms and n is a number from 4 to 15, and (b) from 60% to 40% by weight of at least one compound of the formula $$\begin{array}{l} \qquad\quad R^2—\underset{|}{CH}—\underset{|}{CH_2} \\ H—(OCH_2CH_2)_p—O \quad O—(CH_2CH_2O)_q—H \end{array}$$

wherein $R^2$ represents an alkyl having from 8 to 14 carbon atoms and p and q are each a number from 0 to 15, the sum of p+q being a number from 4 to 15.

The compounds of Formula I are known substances that can be obtained by known methods. Saturated and unsaturated fatty alcohols with 6 to 18 carbon atoms, such as n-hexanol, n-octanol, n-decanol, n-dodecanol, n-tetradecanol, n-hexadecanol, n-octadecanol and 9-octadecanol-(1), can be used as starting materials for the preparation. Usually, however, fatty alcohol mixtures, as they are obtained by sodium reduction or catalytic hydrogenation of fatty acid mixtures from the hydrolytic cleavage of natural fats and oils, are used for the synthesis of these surface-active compounds. Mentioned as examples of such fatty alcohol mixtures are the technical grade alcohols derived from coconut oil, palm kernel oil, tallow, soybean oil and linseed oil. The fatty alcohols and fatty alcohol mixtures are reacted with the proper amount of ethylene oxide at elevated temperature and elevated pressure, in the presence of suitable alkoxylation catalysts, as is well known in the art.

The compounds of Formula II also are known substances. They can be obtained by known methods, by the addition of the respective amount of ethylene oxide to alkane-1,2-diols with 10 to 16 carbon atoms. Mixtures of alkane-1,2-diols with various chain lengths are used preferably for the preparation of the compounds of Formula II. Such alkanediols can be obtained by a known method from 1,2-olefins and mixtures of such olefins by epoxidation and subsequent hydrolysis of the resulting epoxyalkanes.

Respective olefins and olefin mixtures can be obtained, for example, by cracking paraffin hydrocarbons by suitable methods or by the alumino-chemical way in good yields. These olefins are epoxidized by known methods, such as with peracetic acid.

The hydrolysis of the epoxy alkanes also performed according to procedures known from the literature, the method described in U.S. Pat. No. 3,933,923 having been found particularly advantageous. With this method, the epoxyalkanes are hydrolyzed with 1% to 20% by weight of aqueous solutions of salts of aliphatic mono- and/or polycarboxylic acids at temperatures above 100° C. and up to 350° C.

Suitable for this reaction are mainly the alkali metal salts, particularly the sodium salts of acetic acid, propionic acid, butyric acid, caproic acid, caprylic acid and pelargonic acid. Preferred are salts of dicarboxylic acids, such as malonic acid, succinic acid, adipic acid, maleic acid, fumaric acid, azelaic acid and sebacic acid. Mixtures of salts of mono- and dicarboxylic acids can be used as well.

The ratio of the amount of epoxide to be hydrolyzed to the amount of salt solution must be at least 0.5 parts by weight of salt solution per part by weight of epoxide. The use of 2 to 5 parts by weight of salt solution per part by weight of epoxide has been found generally advantageous.

Furthermore, the hydrolysis is carried out suitably in the presence of solvents, such as acetone, dioxane and dioxolane. The solvents are used in amounts of at least 0.5 part by weight per part by weight of epoxide to be hydrolyzed. Especially favorable is a ratio by weight of 2:1. The reaction can be carried out by heating the mixture of epoxide, salt solution and, optionally, solvent, with agitation in the autoclave to the respective reaction temperature, and maintaining this temperature until the hydrolysis is complete. Reaction times of 15 minutes to two hours generally are adequate.

The reaction mixtures can be worked up simply, after distilling off the solvent which may be present, by phase separation with heating.

Starting materials suitable for the preparation of compounds of Formula II are, for example, decane-1,2-diol, dodecane-1,2-diol, a mixture of alkane-1,2-diols with the chain length $C_{11}$–$C_{14}$, a mixture of alkane-1,2-diols with the chain length $C_{12}$–$C_{14}$, a mixture of alkane-1,2-diols with the chain length $C_{12}$–$C_{16}$, and a mixture of alkane-1,2-diols with the chain length of $C_{14}$–$C_{16}$.

For the preparation of the compounds of Formula II, the above-described alkane-diol mixtures are reacted with the respective amounts of ethylene oxide, at elevated temperatures and elevated pressure, in the presence of suitable alkoxylation catalysts. The substances obtained are usually semisolid to solid, wax-like products.

A further way to the compounds of Formula II leads via the reaction of the above-described epoxyalkanes with ethylene glycol and the subsequent ethoxylation of the obtained (2-hydroxyethyl)-hydroxyalkyl ethers. Here, the epoxides obtained from olefin mixtures are reacted in a known manner with excess ethylene glycol, in the presence of acid alkoxylation catalysts, at an elevated temperature and also at an elevated pressure. After the separation of the solvent that may be present, and the excess ethylene glycol, the reaction products obtained are reacted with the provided amount of ethylene oxide at elevated temperature and elevated pressure, in the presence of suitable alkoxylation catalysts, to form the compounds of Formula II. The products produced in this manner also are semisolid to solid, wax-like substances.

Detergent compositions with characteristics particularly favorable from an application technological point of view are obtained when the compounds of Formula I and Formula II used for their preparation have approximately the same hydrophile characteristic. Accordingly, detergent compositions in which the difference between n in Formula I and the sum $p+q$ in Formula II is $\leqq 2$ are a special type of the invention.

The compounds of Formulas I and II are mixed in the desired ratios with the aid of an agitator or a kneader for the preparation of the detergent compositions according to the invention.

The mixed nonionic detergent composition of the invention may also be obtained by mixing a saturated or unsaturated fatty alcohol having 6 to 18 carbon atoms with a member selected from the group consisting of alkane-1,2-diols having 10 to 16 carbon atoms and mixtures thereof and reaction products of epoxyalkanes having 10 to 16 carbon atoms with ethylene glycol and mixtures thereof, in suitable amounts and reacting this mixture with an appropriate amount of ethylene oxide.

The following examples explain the subject matter of the invention in more detail without limiting it however.

EXAMPLE 1

Forty parts by weight of an adduct of 10 mols of ethylene oxide onto a mixture of coconut fatty alcohols with a chain length of $C_{12}$–$C_{18}$ (OH-number 261) were mixed at room temperature with the aid of a propeller agitator apparatus with built-in baffle, with 60 parts by weight of a product that had been prepared by the reaction of a 1,2-epoxyalkane mixture with the chain length of $C_{12}$–$C_{14}$ (7.0 percent by weight epoxide oxygen) with ethylene glycol and subsequent addition of 10 mols of ethylene oxide. The obtained detergent mixture was liquid and dissolved spontaneously in water. No gel formation was observed upon the addition of water.

When an attempt was made to dissolve the adduct of fatty alcohol and ethylene oxide in water without any other addition, a gel was obtained that could not be poured.

EXAMPLE 2

Sixty parts by weight of an adduct of 5 mols of ethylene oxide onto a mixture of tallow fatty alcohols with a chain length of $C_{16}$–$C_{18}$ (OH-number 215) were mixed, as in Example 1, with 40 parts by weight of a product that had been obtained by the reaction of a 1,2-epoxyalkane mixture with a chain length of $C_{12}$–$C_{14}$ with ethylene oxide and subsequent addition of 4 mols of ethylene oxide. The formed mixture was liquid and clear. It dissolved in cold water spontaneously in any ratio.

In contrast to this, the pasty adduct of the ethoxylated tallow fatty alcohol dissolved in water only very slowly and with strong gel formation.

EXAMPLE 3

Forty parts by weight of an addition product of 10 mols of ethylene oxide onto a oleyl/cetyl alcohol mixture (OH-number 216; iodine number 55) were mixed, as in Example 1, with 60 parts by weight of a product that had been obtained by the reaction of a 1,2-epoxyalkane mixture with a chain length of $C_{12}$–$C_{14}$ with ethylene glycol and subsequent addition of 10 mols of ethylene oxide. A liquid, clear detergent mixture was obtained, which dissolved clear and spontaneously in water, without disturbing gel formation.

The adduct of oleyl/cetyl alcohol and ethylene oxide used as starting material was solid. When it was mixed with water without any further addition, a gel was obtained that could not be poured.

EXAMPLE 4

Fifty parts by weight of an addition product of 5 mols of ethylene oxide onto a coconut fatty alcohol mixture with a chain length of $C_{12}$–$C_{18}$ (OH-number 261) were mixed, as in Example 1, with 50 parts by weight of a product that had been obtained by the reaction of a 1,2-epoxyalkane mixture with a chain length of $C_{12}$–$C_{14}$ with ethylene glycol and subsequent addition of 6 mols of ethylene oxide. The resulting mixture was clear and liquid. It dissolved upon pouring into cold water without gel formation.

In contrast to this, the highly viscous, turbid adduct of the coconut fatty alcohol mixture and ethylene oxide dissolved in cold water only with gel formation.

The preceding specific embodiments are illustrative of the practice of the invention. It is to be understood, however, that other expedients known to those skilled in the art or disclosed herein may be employed without departing from the spirit of the invention or the scope of the appended claims.

We claim:

1. A mixed nonionic detergent composition having a reduced viscosity at room temperature and whose aqueous solution has a substantially reduced viscosity at room temperature consisting essentially of:

(a) from 40% to 60% by weight of at least one compound of the formula:

$$R^1—O—(CH_2CH_2O)_n—H$$

wherein $R^1$ represents the hydrocarbon moiety of a fatty alcohol having from 6 to 18 carbon atoms and n is a number from 4 to 15, and (b) from 60% to 40% by weight of at least one compound of the formula:

$$\begin{array}{ccc} & R^2—CH & —CH_2 \\ & | & | \\ H—(OCH_2CH_2)_p—O & & O—(CH_2CH_2O)_q—H \end{array}$$

wherein $R^2$ represents an alkyl having from 8 to 14 carbon atoms and p and q are each a number from 0 to 15, the sum of p+q being a number from 4 to 15.

2. The mixed nonionic detergent composition of claim 1 wherein the difference between n in component (a) and the sum of p+q in component (b) is $\leqq 2$.

* * * * *